United States Patent [19]

Read

[11] Patent Number: 4,557,515

[45] Date of Patent: Dec. 10, 1985

[54] COIL HANDLING DEVICE

[75] Inventor: Owen R. Read, Glocester, R.I.

[73] Assignee: Woodlawn Iron Works, Inc., Pawtucket, R.I.

[21] Appl. No.: 669,597

[22] Filed: Nov. 8, 1984

[51] Int. Cl.[4] ..... B66C 1/54

[52] U.S. Cl. ..... 294/67.22; 294/67.5; 294/86.41; 294/95; 414/684; 414/754; 414/911

[58] Field of Search ..... 414/684, 754, 763, 783, 414/908, 910, 911; 294/67.2, 67.21, 67.22, 67.5, 86.41, 95, 103.2

[56] References Cited

U.S. PATENT DOCUMENTS

| | | | |
|---|---|---|---|
| 2,925,300 | 2/1960 | Kelley | 294/86.41 |
| 3,905,636 | 9/1975 | Westerlund | 294/95 |
| 4,154,470 | 5/1979 | Dalglish | 414/684 X |
| 4,322,198 | 3/1982 | Zuber | 414/754 |
| 4,358,143 | 11/1982 | Cullen | 414/684 X |
| 4,451,198 | 5/1984 | Sanderson | 294/67.5 X |

*Primary Examiner*—Leslie J. Paperner
*Attorney, Agent, or Firm*—William F. Werner

[57] ABSTRACT

A coil handling device which orientates coils on a reel between two positions, e.g., vertical axis and horizontal axis. The device is constructed to be suspended from an overhead hoist and thereby lift or lower a reel to a selected position. The device is constructed to cause the center of gravity of the reel to coincide with the axis of rotation when suspended. Therefore, the forces of resistance caused by weight are eliminated and only friction forces have to be overcome. Hence, a manual device is provided.

2 Claims, 8 Drawing Figures

COIL HANDLING DEVICE

STATEMENT OF INVENTION

The invention is generally related to a coil handling device for lifting and maneuvering a roll of material having an externally accessible axial opening, and is specifically directed to a device of the type which is capable of transferring a roll of material to and from a rest position to a preselected position.

BACKGROUND OF THE INVENTION

Many products, such as paper, film, foil, textile, sheet metal, rope, yarn, wire and cable are wound on rolls, reels or spools which weigh from 50 to 10,000 pounds. Many cannot be lifted or manueuvered manually and require the intervention of some type of powered lifting apparatus.

A number of power lifting coil handing devices and related structures are known. See, for example, U.S. Pat. Nos. 4,322,198 and 4,358,143.

A problem often encountered with the lifting and maneuvering of such heavy reels of material is the turning of the axis of the reel through a 90° arc and the assurance that the reel holding device will not slip inadvertently. To that end a unique coil handling device is hereinafter disclosed.

OBJECTS OF THE INVENTION

Accordingly, it is a principal object of the present invention to overcome the deficiencies of prior art constructions.

Another object of the present invention is to provide a coil handling device with a new and novel reel holding means.

Still another object of the present invention is to provide a coil handling device wherein the center of gravity of the coil handling device passes through the center of the coil support and coil.

Other objects of the present invention will become apparent in part and be pointed out in part in the following specifications and claims.

THE SPECIFICATION

Figure 2:
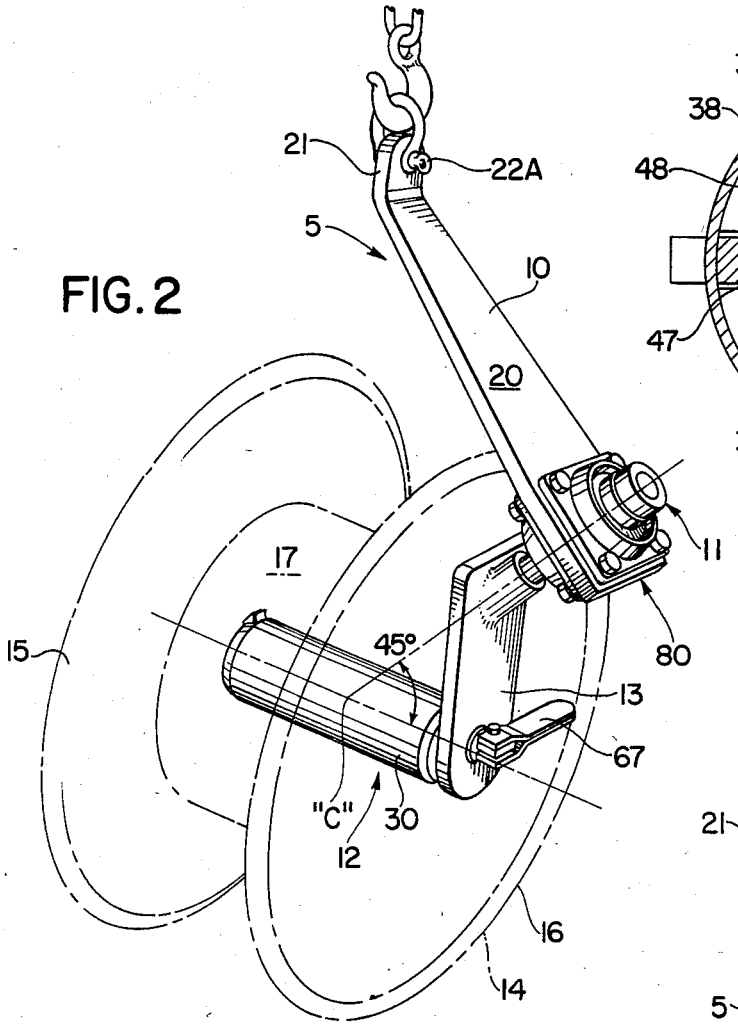
FIG. 2 is a view similar to FIG. 1, with the coil handling device raised by a hoist and the coil handling reel rotated into horizontal axial position.

Referring to the drawings, the new and improved coil handling device 5 consists of an arm 10 provided with a bearing mechanism, generally indicated by reference numeral 11, a jaw mechanism generally indicated by reference numeral 12, and a spindle plate 13 uniting the arm 10, bearing mechanism 11, and jaw mechanism 12 into a coil handling device 5.

A reel or spool, generally indicated by reference numeral 14 comprising a left flange 15 (FIG. 2), a right flange 16 and a barrel 17 uniting the left 15 and right 16 flanges to form a reel. A reel 14 is the selected medium to show the use of the new and novel coil handling device 5.

Figure 7:
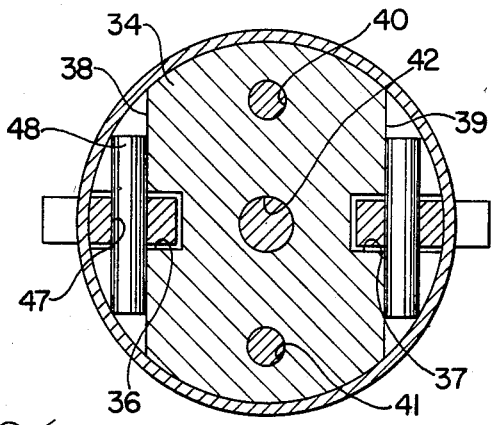
FIG. 7 is a horizontal cross sectional view taken on line 7—7, looking in the direction of the arrows, on FIG. 5.

The arm 10 comprises an extended section 20 having a bent end 21 provided with an opening 22 adapted to accommodate a shakel bolt 22A (see FIGS, 1, 2 and 4). The other end of section 20 is provided with a spindle orifice 25 (see FIG. 4). End 21 is set at an angle of 135° to section 20. Reference is made to FIGS. 4, 5, 6 and 7. The jaw mechanism consists of circular housing 30 fastened to a top plate 31, as by welding. Top plate 31 may be an integral part of spindle plate 13 and shows a manufacturing method. A tube 32 having a hollow area 33 is fastened against top plate 31. A jaw plate 34 is positioned within circular housing 30 abutting tube 32. Jaw plate 34 is provided with left side jaw slot 36 and right side jaw slot 37 as seen in FIG. 7, and with left side jaw pin passageway 38 and right side jaw pin passageway 39. Jaw plate 34 is also provided with a first bolt orifice 40, a second bolt orifice 41 and a cam shaft orifice 42. A first jaw consisting of a lever 44 having a first foot 45, a ledge 46 and a pivot pin orifice 47 is pivotally connected to jaw plate 34 by being pivotally mounted in jaw slot 36 by means of pivot pin 48 passing through left side jaw pin passageway 38 and pivot pin orifice 47. In like manner, a second jaw consisting of a lever 44A having a second foot 45A, a ledge 46A and a pivot pin orifice 47A is pivotally connected to jaw plate 34 by being pivotally mounted in jaw slot 37 by means of pivot pin 48A passing through right side jaw pin passageway 39 and pivot pin orifice 47A.

Figure 8:
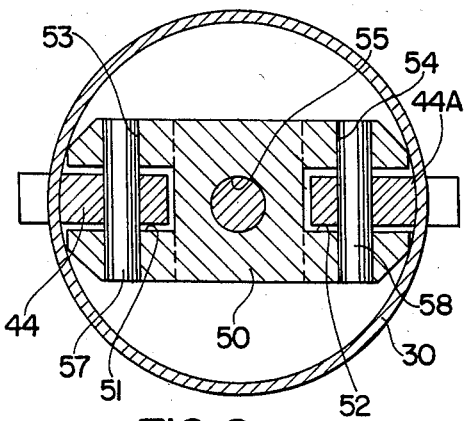
FIG. 8 is a horizontal cross sectional view taken on line 8—8, looking in the direction of the arrows, on FIG. 5.
Figure 4:
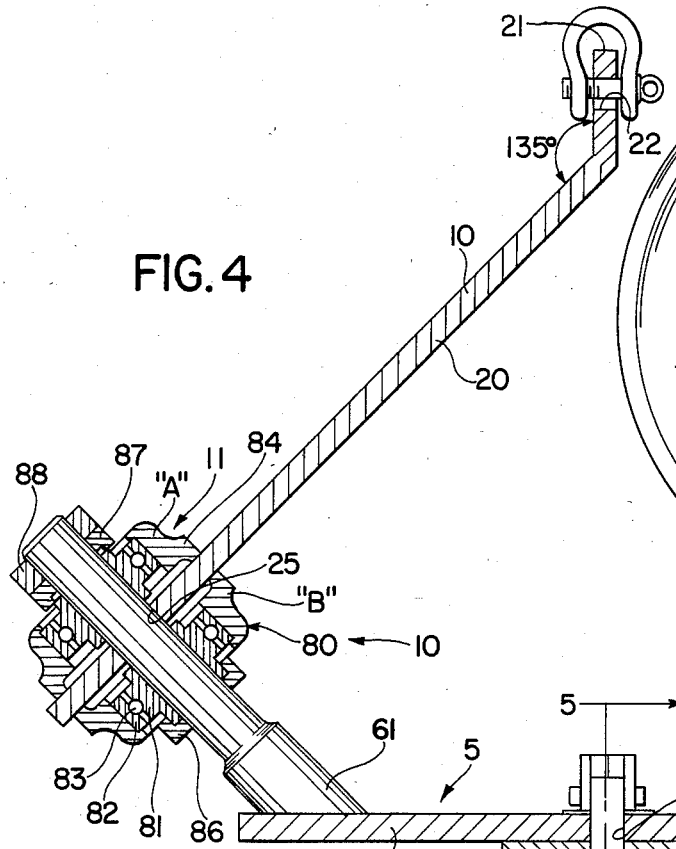
FIG. 4 is a vertical cross sectional view taken on line 4—4 of FIG. 1.
Figure 3:
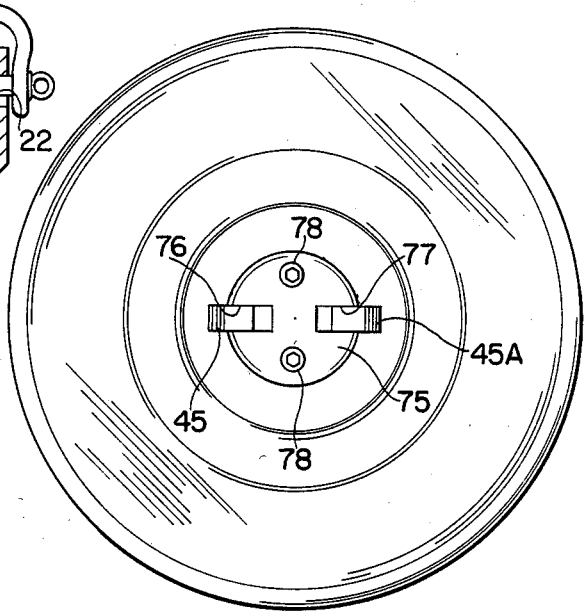
FIG. 3 is a bottom plan view of the coil handling reel showing the jaws of the coil handling device extended to reel lifting position.
Figure 5:
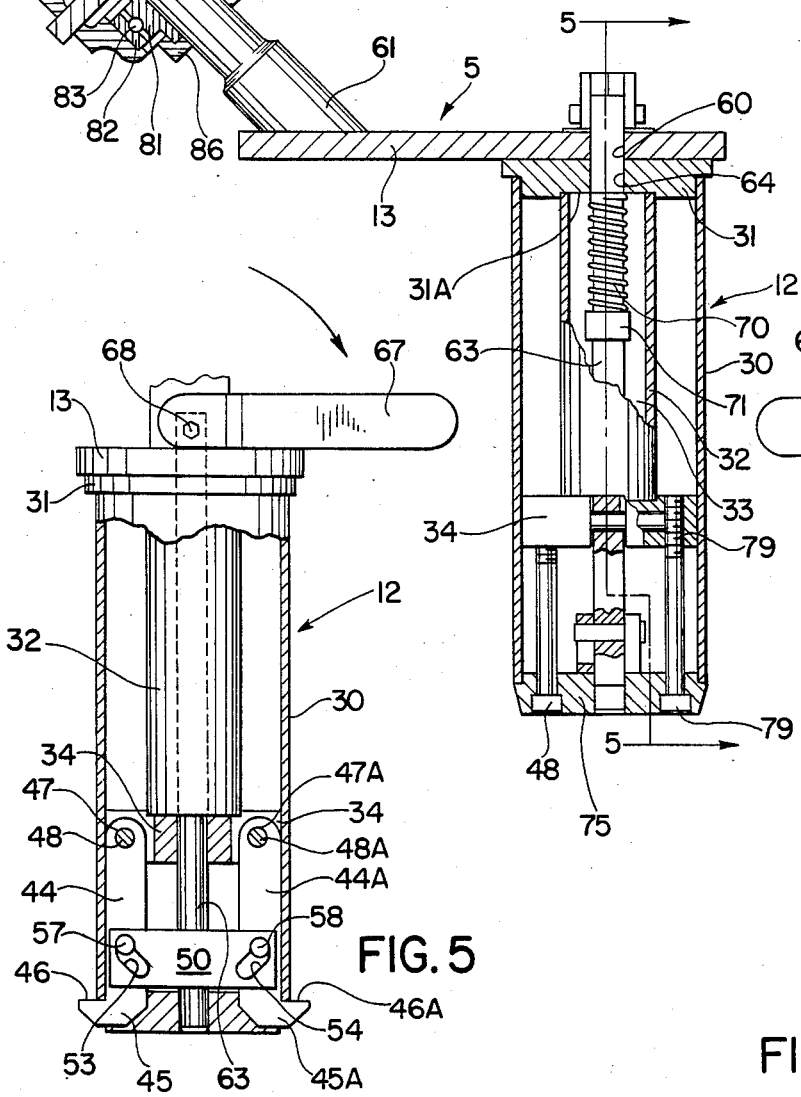
FIG. 5 is a vertical cross-sectional view taken on line 5—5 through the jaw mechanism of FIG. 4 showing the jaws in extended position.

Reference is made to FIGS. 3, 4, 5, 6 and 8. A yoke cam plate 50 is positioned within circular housing 30 and is slidably mounted therein. Cam plate 50 is provided with a left side jaw slot 51 and a right side jaw slot 52 as seen in FIG. 8, and with a left side jaw pin cam orifice 53 and a right side jaw pin cam orifice 54. Cam plate 50 is also provided with a cam shaft passageway 55. A left side cam pin 57 is fastened in lever 44 and extends into left side jaw pin cam orifice 53. In like manner, a right side cam pin 58 is fastened in lever 44A and extends into right side jaw pin cam orifice 54.

Spindle plate 13 is provided with a cam shaft orifice 60 and a spindle 61 fastened thereto and set at a 45° angle to a vertical plane "B", "B" passing through the cam shaft 63 for purposes which will presently appear.

Top plate 31 is provided with a relief orifice 64 aligned with cam shaft orifice 60, and is fastened to spindle plate 13, as by welding. A cam shaft 63 is fastened in cam shaft passageway 55, cam shaft orifice 42, relief orifice 64, spindle orifice 60 to project above spindle plate 13. With reference to FIGS. 1, 2, 4, 5 and 6, a yoked handle 67 is pivotally fastened to the top of cam shaft 63 by means of a pintel 68. A coil spring 70 is placed upon cam shaft 63. One end of the spring 70 abuts the bottom 31A of top poate 31. A collar 71 is fastened in selected position upon cam shaft 63 to abut the bottom of coil spring 70 and selectively tension spring 70. Cam plate 50 is fastened to cam shaft 63 so that yoke handle 67 when pivoted from right to left, (FIGS. 5 and 6), causes cam plate to move from up position FIG. 6, to down position FIG. 5, thereby moving cam pins 57, 58 attached to jaws 44, 44A downward by means of cam orifices 53, 54 to force edges 46, 46A from rest to working position by extending beyond circular housing 30, and against the tension of spring 70, thereby to hold ledges 46, 46A in extended or working position.

A circular bottom plate 75, see FIGS. 3,4, 5 and 6, provided with relief slots 76, 77 is fastened in the bottom of circular housing 30, with first foot 45 slidably mounted in slot 76 and second foot 45A slidably mounted in slot 77. Two bolts 78 and 78 are fastened in jaw plate 34 by means of threads 79 to thereby secure bottom plate 75 in circular housing 30 and hold tube 32 in position between bottom 31A and jaw plate 34.

A conventional ball bearing, generally indicated by reference numeral 80 consists of an inner race 81, an outer race 82 with a plurality of ball bearings 83 between the inner 81 and outer race 82. A housing 84 encapsulates the inner 81 and outer 82 races. Extended section 20 is provided with a bearing orifice 85 which is rotatably mounted on spindle 61. Ball bearing 80 is in two half sections "A" and "B" which are positioned on opposite sides of section 20 and are fastened thereto by means of lower collar 86 and upper collar 87 with a retaining collar 88 fastened to the end of spindle 61.

Figure 1:
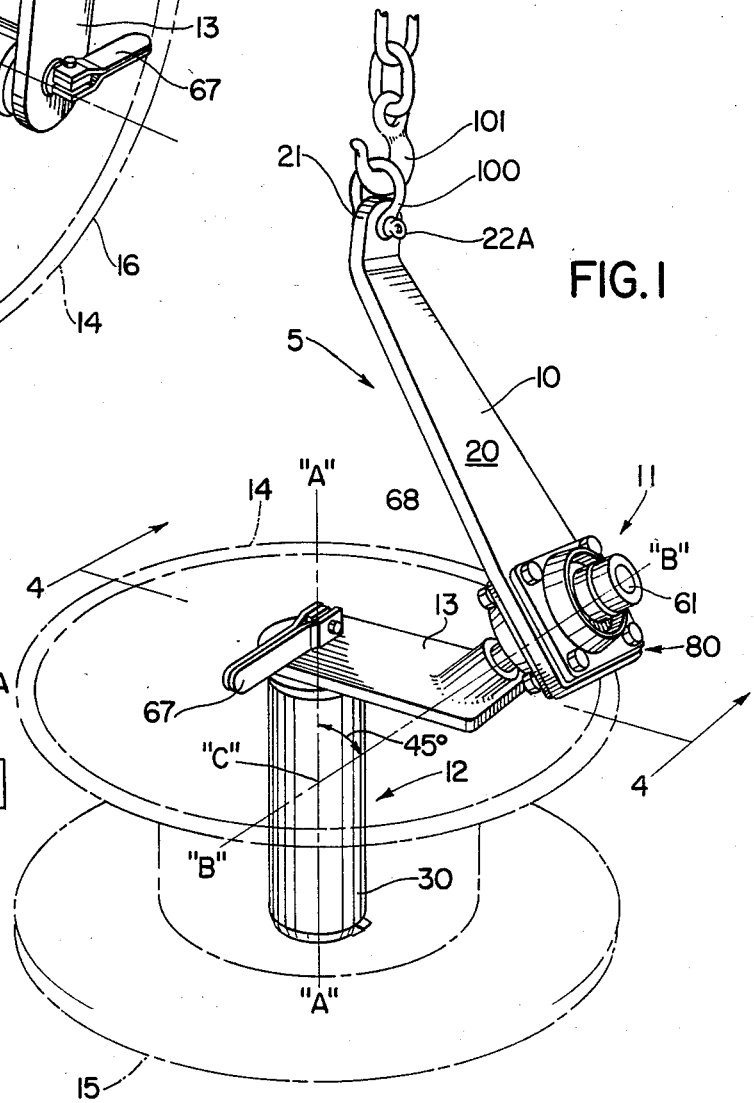
FIG. 1 is a perspective view of the new and improved coil handling device showing the coil handling support or reel in vertical position with the coil handling device attached thereto, ready to be lifted by a hoist.

Reference is made to FIGS. 1 and 2. In FIG. 1, a vertical line "A"—"A" passes through the axis of cam shaft 63. The plane "B"—"B" passing through spindle 61 at a 45° angle to vertical plan "A"—"A" passes through the mid point "C" distance of cam shaft 63, between flanges 15, 16. This mid-point "C" is the center of gravity of the coil on reel 14. If the distance between flanges increases or decreases the angle of 45° and plane "B"—"B" will increase or decrease to maintain the center of gravity of the spool in relation to the coil handling device 5.

Figure 6:
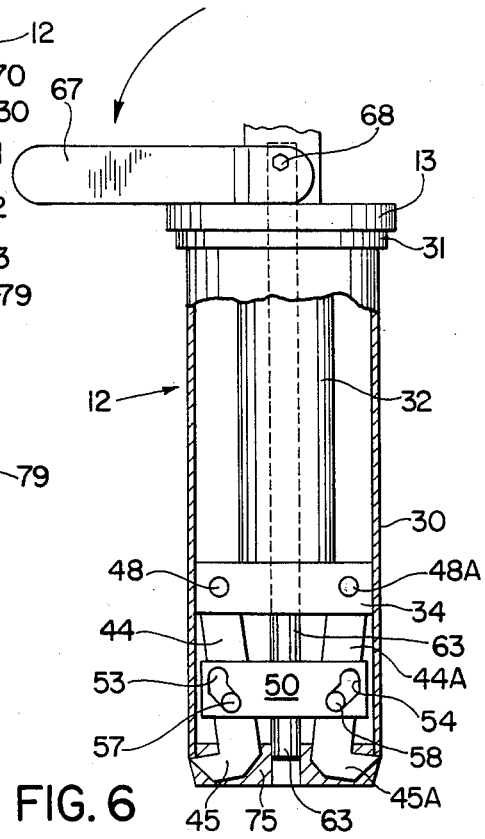
FIG. 6 is a view similar to FIG. 5 showing the jaws in retracted position.

In operation, reel 14 will have coils of steel cable wound upon barrel 17 between flanges 14, 15. Let it be assumed that reel 14 is in the position shown in FIG. 1 and that three or more wooden blocks underlie flange 15 so as to space flange 15 above the floor. Jaw mechanism 12 will be inserted into barrel 17 with the jaws 45, 45A withdrawn as seen in FIG. 6 but extending beyond flange 15. Ledges 46, 46A will engage the outside or underlying surface of flange 15 as yoke handle 67 is moved through an arc from the horizontal position shown in FIG. 6 to the horizontal position shown in FIG. 5. The pivotal arcuate movement of handle 67 will cause the cam shaft 63 to move downward including cam plate 50 and collar 71. Downward movement of collar 71 will permit compression coil spring 70 to extend and hold ledges 46, 46A against flange 15.

A shakel 100, provided with bolt 22A attached to bent end 21, is adapted to receive a hook 101 attached to an overhead hoist (not shown). Upward movement of hook 101 will cause reel 14 to pivot around spindle 61 to the position shown in FIG. 2. It will be noted that the center of gravity of reel 14 remains constant during this pivotal movement.

The pivotal movement of handle 67 from the position shown in FIG. 2 to the position shown in FIG. 8 causes cam shaft 63 to move upward carrying cam plate 50 and collar 71 upward to draw jaws 45, 45A inward through the travel of pivot pins 57, 58 in cam slots 53, 54, respectively, thereby disengaging ledges 46, 46A from flange 15.

Having shown and described a preferred embodiment of the present invention by way of example, it should be realized that structural changes could be made and other examples given without departing from either the spirit or scope of this invention.

What I claim is:

1. A coil handling device comprising an arm provided with a bearing mechanism on one end and a bent end having an opening on the other end, adapted to accommodate a lifting mechanism, a spindle plate provided with a cam shaft orifice and a spindle, means fastening said spindle to said spindle plate at an angle of 45° to the horizontal plane of said spindle plate, means pivotally mounting said spindle within said bearing mechanism, and a jaw mechanism comprising a circular housing, means fastening said circular housing to said spindle plate at a 90° angle to said horizontal plane of said spindle plate, a tube having a hollow area, means fastening said tube to said spindle plate and located within said circular housing, a jaw plate positioned within said circular housing, means fastening said jaw plate to said circular housing, said jaw plate having a left side jaw slot and a right side jaw slot, and with a left side jaw pin passageway and a right side jaw pin passageway, said jaw plate provided with a first bolt orifice, a second bolt orifice and a cam shaft orifice, a first jaw lever having a foot, a ledge and a pivot pin orifice, said first jaw lever located in said left side jaw slot a pivot pin located in said left side jaw pin passageway and pivot pin orifice to pivotally connect said first jaw lever to said jaw plate, a second jaw lever having a foot, a ledge and a pivot pin orifice said second jaw lever located in said right side jaw slot, a pivot pin located in said right side jaw pin passageway and pivot pin orifice to pivotally connect said second jaw lever to said jaw plate, a yoke cam plate slidably mounted within said circular housing and provided with a left side jaw slot and a right side jaw slot, and with a left side jaw pin cam orifice and a right side jaw pin cam orifice, and a cam shaft passageway, said first jaw lever located in said left side jaw slot, a left side cam pin fastened in said first jaw lever and extends into left side jaw pin cam orifice, a right side cam pin fastened in said lever and extends into right side jaw pin cam orifice, a cam shaft fastened in cam shaft passageway, slidably passes through shaft orifice and spindle orifice to project above spindle plate, a coil spring loosely mounted on cam shaft abuts spindle plate on one end and in selected position on cam shaft by means of a collar fastened to cam shaft on the opposite end, a yoke handle pivotally connected to the end of cam shaft moves cam shaft and yoke cam plate up and down against the tension of coil spring, a circular bottom plate provided with relief slots is fastened in the bottom of circular housing by means of bolts fastened in jaw plate and thereby secure tube in position between bottom and jaw plate, and with said first foot and second foot slidably mounted in respective relief slots.

2. Apparatus as set forth in claim 1 wherein a vertical plane passes through the axis of said cam shaft, a second plane passing through the axis of said spindle at a forty-five degree angle to said vertical plane bisects said vertical plane at the mid point distance between flanges of a reel, said flanges being eleven inches apart, said bent end being inclined one hundred thirty-five degrees from said arm, when said arm is suspended, said second plane passing through the axis of said vertical plane locates the center of gravity of the coil handling device.

* * * * *